US007707776B2

(12) United States Patent
Weissofner et al.

(10) Patent No.: US 7,707,776 B2
(45) Date of Patent: May 4, 2010

(54) FRAMELESS GLASS DOOR

(75) Inventors: Claus Weissofner, Schwarzach im Pongau (AT); Karl Weissofner, Schwarzach im Pongau (AT)

(73) Assignee: Dorma GmbH + Co. KG, Ennepetal (DE)

( * ) Notice: Subject to any disclaimer, the term of this patent is extended or adjusted under 35 U.S.C. 154(b) by 12 days.

(21) Appl. No.: 11/886,511

(22) PCT Filed: Mar. 20, 2006

(86) PCT No.: PCT/EP2006/060890

§ 371 (c)(1),
(2), (4) Date: Sep. 17, 2007

(87) PCT Pub. No.: WO2006/097542

PCT Pub. Date: Sep. 21, 2006

(65) Prior Publication Data

US 2008/0172946 A1 Jul. 24, 2008

(30) Foreign Application Priority Data

Mar. 18, 2005 (AT) ..... A 463/2005

(51) Int. Cl.
*E05D 7/08* (2006.01)

(52) U.S. Cl. ..... 49/388; 49/397; 49/398

(58) Field of Classification Search ..... 49/388, 49/397, 398, 501

See application file for complete search history.

(56) References Cited

U.S. PATENT DOCUMENTS

| | | | | |
|---|---|---|---|---|
| 2,191,900 | A * | 2/1940 | Pariot | 16/253 |
| 2,219,683 | A * | 10/1940 | Erath | 49/388 |
| 3,653,156 | A * | 4/1972 | Horgan, Jr. | 49/501 |
| 3,662,493 | A * | 5/1972 | Foltz | 49/388 |
| 3,828,394 | A * | 8/1974 | Horgan, Jr. | 16/241 |
| 5,283,978 | A * | 2/1994 | Horgan, Jr. | 49/388 |
| 6,161,255 | A * | 12/2000 | Garrett | 16/284 |
| 6,826,870 | B2 * | 12/2004 | Chiang | 49/388 |
| 6,966,150 | B2 * | 11/2005 | Chiang | 49/388 |
| 7,107,723 | B2 * | 9/2006 | Chiang | 49/388 |
| 7,178,198 | B2 * | 2/2007 | Elmer | 16/252 |
| 7,305,796 | B2 * | 12/2007 | Chiang | 49/388 |

FOREIGN PATENT DOCUMENTS

| | | | |
|---|---|---|---|
| DE | 100 23 762 | | 11/2001 |
| DE | 202 20 773 | | 3/2004 |
| JP | 06002462 | A * | 1/1994 |

OTHER PUBLICATIONS

Search Report dated Jun. 27, 2006 for the underlying International Application No. PCT/EP2006/060890.

* cited by examiner

*Primary Examiner*—Jerry Redman
(74) *Attorney, Agent, or Firm*—Cohen Pontani Lieberman & Pavane LLP

(57) ABSTRACT

A frameless glass door arrangement for a doorway bounded in part by a top section and a bottom section is disclosed. The frameless glass door arrangement includes two hinge parts rotatably embedded in the respective top section and bottom section; and a glass door leaf including a main body including a top edge, a bottom edge and a lateral edge, the glass door leaf further including two tongue-shaped extensions disposed adjacent to the lateral edge. The extensions extend outward from the respective top edge and bottom edge of the main body and into the respective hinge parts so that the doorway is completely transparent after the glass door leaf is installed in the doorway.

5 Claims, 3 Drawing Sheets

FRAMELESS GLASS DOOR

CROSS-REFERENCE TO RELATED APPLICATIONS

This is a U.S. national stage of International Application No. PCT/EP2006/060890, filed on 20 Mar. 2006. Priority is claimed on Austrian Application No. A463/2005, filed on 18 Mar. 2005.

BACKGROUND OF THE INVENTION

1. Field of the Invention

The invention pertains to a frameless glass door, especially a swinging glass door or a door which rests in stops, with a glass door leaf installed in a doorway and with hinges at the bottom and top or on the side.

2. Description of the Related Art

Glass facades, glass walls, and glass doors have become widely accepted not only for business entryways but also for offices and in the area of modern interior architecture. They offer an unimpeded view in both directions and contribute to a feeling of openness and to a connection between indoors and outdoors. Barriers are thus eliminated, and "threshold anxiety" is reduced in business areas.

Glass doors require fittings, especially hinges, which are usually made of metal and which must be attached to the glass door leaf by flanges at the top and bottom. For this purpose, U-profiles of metal are used, which grip the hinge-side corner areas and partially enclose and thus support the glass door leaf. The axes of rotation or mandrel mounts, which engage in mating parts in the floor or ceiling structure, are located on these metal profiles.

A special type of design is based on a multi-layer laminated glass pane. A flat piece of a hinge part is embedded in the laminated construction, so that the glass is not enclosed as usual between two cheeks of a U-profile but rather encloses the hinge part.

It is felt to be a disadvantage of the prior art that, although these glass doors are indeed frameless, they still have visible metal hinge parts.

SUMMARY OF THE INVENTION

The invention has the goal of freeing the glass door leaf of all visible hinge parts and of designing the entire doorway so that it is completely transparent.

This goal is achieved for a frameless glass door of the type described above, in that the glass door leaf has a tongue-like glass extension in the area of each hinge. These extensions project toward the doorway beyond the geometric form, in particular the rectangular form, of the glass door leaf and fit into rotatable hinge parts outside the visible area.

Although we are speaking here of a glass door, all of the features also apply correspondingly to other types of glass leaf structures such as windows. All of the hinge parts are therefore always located outside the doorway; that is, they are entirely inside the floor or ceiling structure or completely out of sight in a door post. The glass extensions are parts of the door leaf and represent the invisible connection between the door and the hinges, which are also invisible. It is advisable for the glass door leaf and the glass extensions to be made out of a single piece of material. Modern adhesives, however, can also be used to attach the extensions to the edges of the glass. If the refractive properties of the adhesive are the same as those of the glass, the joint will remain completely invisible, even if it is shaped or grooved to increase its strength. Finally, it is advantageous for the glass extensions and for the rotating hinge parts to be permanently bonded to each other by means of an adhesive, for example, and for the rotating hinge part to be mounted on a pin, e.g., the pin of a bottom door closer. The glass extensions engage in gaps, grooves, or openings in the profile of the rotating hinge parts and are anchored in place there. All of these areas are outside the doorway and are entirely out of sight. The glass extensions can engage in grooves on the diameter of the cylindrical bearing pieces, which are able to turn in nonrotatably installed bearing shells, the turning angle preferably being limited by stops. The bearing pieces and the bearing shells can be designed as radial and axial roller bearings or ball bearings. Underneath the bottom or the top cylindrical bearing piece, a door closer can be installed, the pin of which (e.g., a square pin) positively engages in a corresponding opening in the bottom of the bearing piece. The entire unit consisting of the nonrotating bearing shell and (if present) the door closer can be lowered or raised into a recessed installation box on threaded spindles (spacer screws), so that at least one glass extension, together with its cylindrical bearing piece, can be released, thus allowing the glass door to be removed.

BRIEF DESCRIPTION OF THE DRAWINGS

Exemplary embodiments of the object of the invention are illustrated in the drawings.

DETAILED DESCRIPTION OF THE PREFERRED EMBODIMENTS

Figure 1:
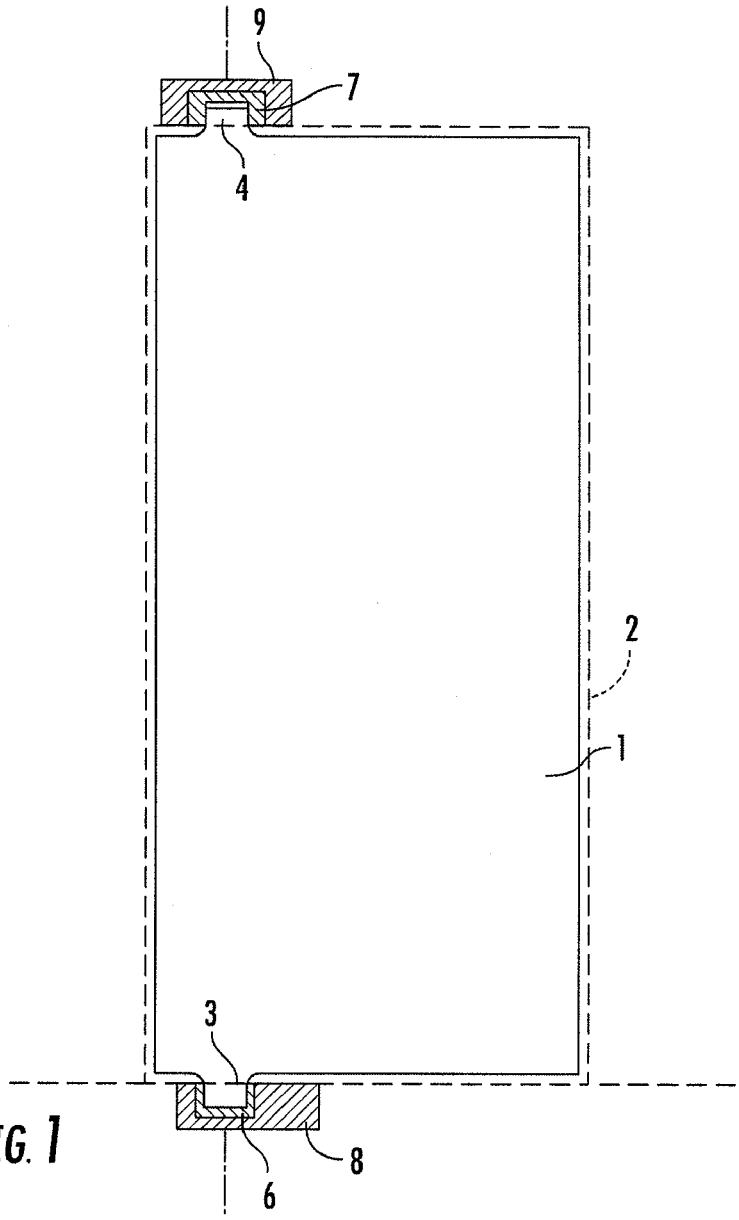
FIG. 1 shows a cross section of a frameless glass door with its hinges in a doorway.

According to FIG. 1, a glass door leaf 1 completely fills a doorway 2, illustrated in dashed line. No hinge fittings or hardware parts can be seen inside the dashed outline of the doorway 2. The glass door leaf 1, in the embodiment according to FIGS. 1-4, has tongue-like glass extensions 3, 4 on the narrow sides of the rectangular main body of the glass door leaf 1, near one of the long sides. These glass extensions 3, 4 project beyond the doorway 2, i.e., beyond the dashed line of the doorway 2 in FIG. 1, and fit into openings 5 in rotating, cylindrical hinge parts 6, 7. These cylindrical hinge parts 6, 7 are bearing pieces such as bearing journals, which are mounted with freedom to turn in nonrotatably installed bearing shells 8, 9 in the manner of friction bearings. Roller bearings or ball bearings acting in the radial and/or axial direction between the hinge parts 6, 7 and the stationary bearing shells 8, 9 are also possible. When the shells are lowered into a recess located underneath, the rotating hinge parts 6, 7 disengage, and the glass door can be removed.

Figure 2:
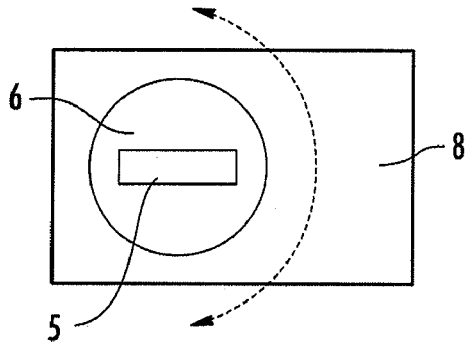
FIG. 2 shows a top view of the bottom hinge.
Figure 3:
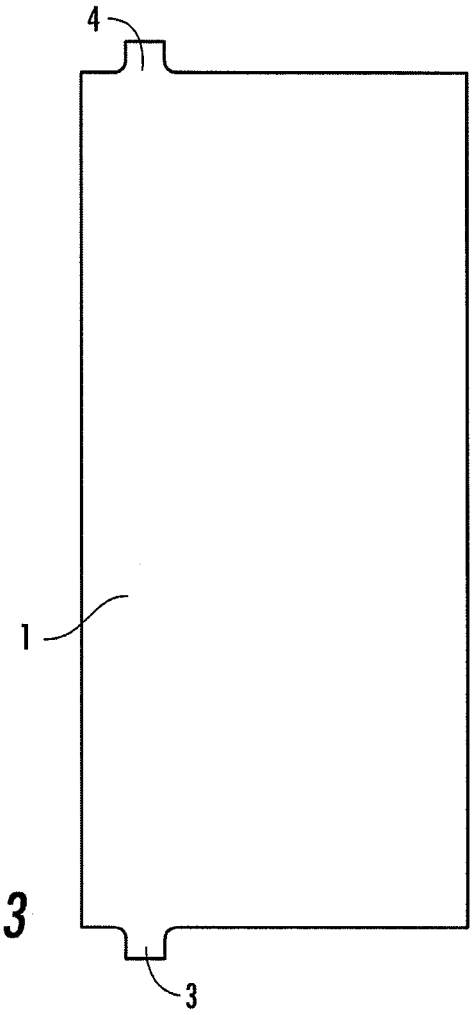
FIG. 3 shows a view of the glass door leaf.

FIG. 2 shows a top view of the bottom hinge part 6, the opening 5 in which is designed as a diagonal slot or groove, which positively holds the glass extension 3. In a concrete exemplary embodiment, the glass extensions had a projecting length of approximately 2 cm and a width of 5-6 cm. Under consideration of the floor gap of 5 mm, the depth of the opening 5 was approximately 1.5 cm; the length of the opening 5 was approximately 5-6 cm; and the width was the same as that of the safety glass. This hinge part 6, which is made of metal, could also be bonded to the glass extension 3 by the use of a suitable adhesive.

The production of the glass door leaf 1 begins with a glass plate which is a few (e.g., four) centimeters too long, and then, by the use of modern high-pressure jet methods, the narrow sides are cut back in such a way that the glass extensions 3, 4 are formed.

Figure 4:
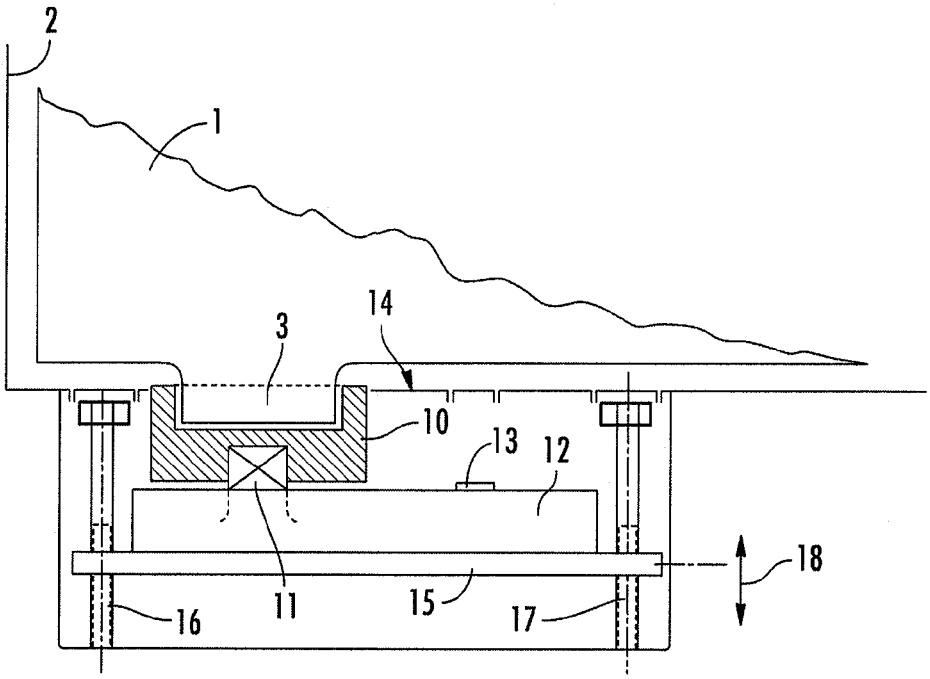
FIG. 4 shows a partial cross section of a corner area of a doorway with a glass door leaf and hinge on a bottom door closer.

In the design according to FIG. 4, the glass extension 3 fits into a rotating hinge part 10, which has a square recess at the bottom. A pin 11 of a bottom door closer 12 engages in this square recess. When, therefore, the frameless glass door is opened, the hinge part 10 turns by 75°, for example, and thus loads the bottom door closer 12 by way of the positively engaging pin 11. The closer then makes sure that the hinge part 10 is braked as it returns and thus allows the glass door to close. The braking behavior of the bottom door closer and also the holding of the door in the 90° position can also be adjusted by means of one or more adjusting screws 13. For this purpose, a cover 14 can be removed, or the cover can have closeable access openings for screwdrivers or wrenches.

FIG. 4 also shows that the entire previously described assembly (bottom door closer 12 with pin 11) is mounted on a plate 15, which can be lowered (arrow 18) by way of spindles, e.g., threaded bolts 16, 17, with hexagonal heads or heads with hexagonal sockets in them. In the lowered state, the pin 11 is disengaged from the hinge part 10, and the glass door leaf 1 together with the hinge part 10 can be removed sideways from the doorway. For this purpose, in FIG. 4, the cover 14, which is divided down the middle (in the plane of the drawing), must also be removed.

If the glass extensions 3, 4 are not bonded by an adhesive to the hinge parts 6, 7, or 10 but merely fit positively into the openings 5, the glass door leaf 1 can be removed simply by lowering all of the components, including the hinge part 10.

Figure 5:
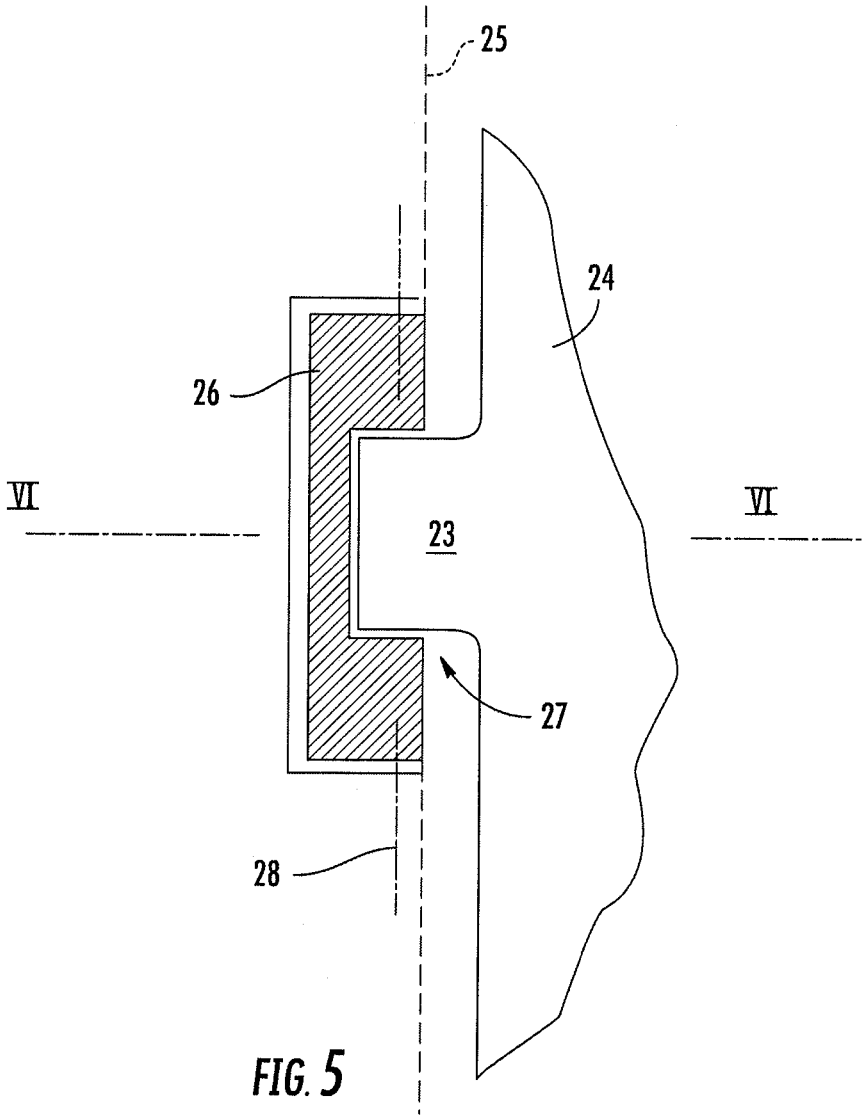
FIG. 5 shows a cross section of another embodiment of a hinge.
Figure 6:
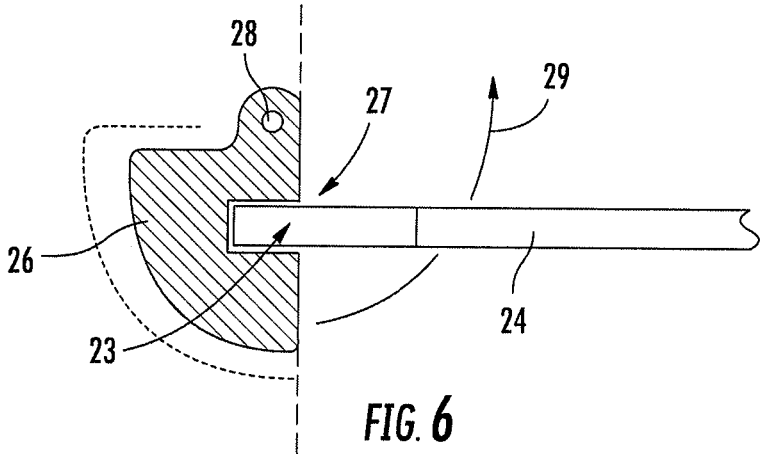
FIG. 6 shows a cross section along line VI-VI in FIG. 5.

An embodiment according to FIGS. 5 and 6 is also possible, in which glass extensions 23 are provided on one of the long sides of the glass door leaf 24, one near the bottom and one near the top. These glass extensions 23 project beyond the dashed-line doorway 25, and each fits into a rotating hinge part 26. The slot 27 formed for this purpose and the axis of rotation 28 can be seen in FIG. 6. The glass extensions 23 can be bonded adhesively in the slots 27, or screws can be used, which pass through holes in the glass extensions 23. So that the glass door can be opened a full 90°, the hinge part 26 can pivot as shown by the arrow 29 in FIG. 6. When the door is closed, the hinge part 26 disappears completely from the area of the doorway 25. The exemplary embodiment according to FIGS. 5 and 6 has a rotating hinge part 26 in the form of a cylinder with a base in the form of a quarter circle. The axis of rotation is near the center of the imaginary complete circle. When the door is closed, the rotating hinge part 26 lies completely in an opening of complementary shape in a door post. When the door is opened, the hinge part 26 pivots out and allows the door to open a full 90°.

What is claimed is:

1. A frameless glass door arrangement for a doorway bounded in part by a top section and a bottom section each having a predetermined contour, the frameless glass door arrangement comprising:

two hinge parts rotatably embedded in the respective top section and bottom section; and a glass door leaf comprising:

a main body comprising a top edge, a bottom edge and a lateral edge, the top and bottom edges of the main body having the respective predetermined contours of the top and bottom doorway sections; and two tongue-shaped extensions disposed adjacent to the lateral edge, wherein the extensions extend outward from the respective top edge and bottom edge of the main body and into the respective hinge parts so that the entire doorway provides an unobstructed view when the glass door leaf is in a closed position in the doorway, and the main body and the extensions are integrally formed as a single piece of material.

2. The frameless glass door arrangement of claim 1, wherein the extensions are bonded to the respective hinge parts.

3. The frameless glass door arrangement of claim 2, further comprising a door closer embedded in one of the top section and the bottom section and comprising a pin, a respective hinge part being mounted on the pin.

4. The frameless glass door arrangement of claim 2, further comprising threaded spindles engaging the door closer, the door closer being movable away from the glass door leaf so that the respective hinge part can be disengaged from the pin to allow the glass door leaf to be removed from the doorway.

5. The frameless glass door arrangement of claim 1, further comprising two bearing shells non-rotatably embedded in the respective top section and bottom section, the hinge parts being seated in the respective bearing shells, at least one of the bearing shells being movable away from the glass door leaf so that the respective hinge part can be disengaged from the at least one of the bearing shells to allow the glass door leaf to be removed from the doorway.

* * * * *